US005447084A

United States Patent [19]

Althaus

[11] Patent Number: 5,447,084

[45] Date of Patent: Sep. 5, 1995

[54] RAZOR HEAD OF A WET RAZOR

[76] Inventor: Wolfgang Althaus, Hülsberg 94,, D-5600 Wuppertal 12, Germany

[21] Appl. No.: 27,123

[22] Filed: Mar. 5, 1993

[30] Foreign Application Priority Data

Mar. 6, 1992 [GB] United Kingdom ..... 9204825

[51] Int. Cl.[6] ..... B21K 11/00; B26B 21/22

[52] U.S. Cl. ..... 76/104.1; 76/119; 30/78; 30/346.56

[58] Field of Search ..... 30/32, 27, 50, 51, 77, 30/78, 346.5, 346.56; 76/104.1, 119

[56] References Cited

U.S. PATENT DOCUMENTS

| | | | |
|---|---|---|---|
| 1,846,622 | 11/1930 | Thompson | 30/346.56 |
| 3,505,734 | 4/1970 | Iten . | |
| 3,750,285 | 8/1973 | Michelson . | |
| 4,094,066 | 6/1978 | Daniel, Jr. . | |
| 4,916,814 | 4/1990 | Althaus . | |
| 5,063,668 | 11/1991 | Althaus . | |
| 5,063,669 | 11/1991 | Althaus | 30/50 |
| 5,090,124 | 2/1992 | Althaus | 30/346.5 |
| 5,161,307 | 11/1992 | Althaus | 30/50 |

FOREIGN PATENT DOCUMENTS

| | | |
|---|---|---|
| 0389007 | 1/1987 | European Pat. Off. . |
| 0348866 | 1/1990 | European Pat. Off. . |
| 0453717 | 10/1991 | European Pat. Off. . |
| 1909989 | 1/1970 | Germany . |
| 9210042 | 10/1992 | Germany . |
| 1542299 | 3/1979 | United Kingdom . |
| 8909121 | 10/1989 | WIPO . |

*Primary Examiner*—Richard K. Seidel
*Assistant Examiner*—Jay A. Stelacone
*Attorney, Agent, or Firm*—Robert W. Becker & Associates

[57] ABSTRACT

To improve the method for fixing protective strands to a razor head, the razor head is provided with a plastic body having an upper side that defines a surface for engaging the skin of the user, with the plastic body also having a front side and a back side. A razor blade unit is disposed in the plastic body. A series of strands are spaced along the length of the blade unit and are fixedly attached directly to said blade unit.

8 Claims, 4 Drawing Sheets

RAZOR HEAD OF A WET RAZOR

BACKGROUND OF THE INVENTION

The present invention relates to a razor head, and especially a razor blade unit, disposed at the front end of a handle of a wet razor. A razor blade means in the form of a single or double razor blade is disposed in a plastic body. In the vicinity of the upper side of the razor head that defines a surface for engaging the skin of a user, protecting strands extend over the butting edges of the razor blade means at a distance from one another and parallel to the direction of shaving.

Various embodiments of wet or safety razors are known. In each case, disposed at the front end of a handle is a razor head that carries the single or double razor blade. The razor head can be integrally formed with the handle as a molded plastic part. If the razor head is separate from the handle and is to be secured thereto in an exchangeable manner via an appropriate mechanism, it is designated as a so-called razor blade unit, with a single or double razor blade being fixedly embedded in a plastic housing.

A razor head in the form of such a razor blade unit is disclosed in EP 0 389 007. A wire having a number of adjacent windings is wound around the plastic body in which the double razor blade is embedded. In the vicinity of that surface of the razor blade unit that engages the skin of a user, the individual windings extend at a distance from one another and parallel to the direction of shaving, while at the underside of the plastic body the windings extend at an angle. This protective wire winding significantly improves the shaving characteristics. For example, the wire prevents the formation of folds or bulges of the skin, so that injury to the skin can also be prevented in non-visible areas. Furthermore, the wire reduces the actual shaving resistance, since it reduces the frictional forces. Finally, the protective wire prevents the user from accidentally cutting himself during improper handling of the razor blade unit at the razor blades thereof.

Unfortunately, with the heretofore known razor head, the wire also extends in the vicinity of the razor blade unit, namely in the region where the razor blade unit must be secured to the handle. Thus, the windings of the wire and the securing mechanism interfere with one another. Furthermore, with the wire winding of the heretofore known razor blade unit, the danger exists that the wire can shift to the side. Additionally, wire winding of blade units is complicated and does not lend itself to fast mass production.

It is therefore an object of the present invention to provide a razor head, and in particular a razor blade unit, that has protective strands provided by an improved method.

SUMMARY OF THE INVENTION

The razor head of the present invention is characterized primarily by protecting strands that are fixed to the blade unit in a way that does not involve the complicated process of wrapping an individual wire around the blade unit a number of times.

A razor head, and in particular a razor blade unit, that is constructed pursuant to the teaching of the present invention has the advantage that the underside of the plastic body remains free, so that the handle can be secured to the underside of the razor head without difficulty. Thus, in particular in the case of razor blade units, all possible securement systems can be utilized. Furthermore, with the inventive orientation of the fixed strands, a shifting of this wire to the side is prevented.

Pursuant to one specific embodiment of the present invention, it is proposed that conventional wires be welded to the upper surface of the blade or blades. Such wires can be located across the top of the blade unit at the required spacing and can be secured in position by a simple spot weld.

Pursuant to a further specific embodiment of the inventive razor heads, the protective strands are formed by a bead line of weld or glue or plastic on the upper surface of the blade or blades. In this embodiment there is no requirement for the use of wires or meshes at all.

Thus, the protecting strands can be secured directly to the razor blade means and, if required, to the support means, thus eliminating the need for some other securement.

If a double razor blade is provided, it is proposed pursuant to a further specific embodiment that the two razor blades be secured to both sides of a spacer that is disposed between them, with the thus-formed razor blade/spacer/razor blade unit essentially being inserted from above onto a platform or support means of the plastic body. The advantages mentioned in connection with a single razor blade also apply to this embodiment.

If the razor head has a rear cover and a forward guardbar, which is preferably provided with a stepped longitudinal profiling, it is proposed pursuant to a further specific embodiment of the present invention that in the vicinity of the guide strip and the cover, the protective strands be guided below these components and be covered thereby. Thus, the protective strands extend between the guardbar or cover and the actual plastic body with its blade support means. As a consequence of this configuration, the function of the forward guardbar, especially with its stepped longitudinal profiling, is not reduced by the friction-reducing strand portions, since the forward guardbar is particularly required for prestressing the skin. The same applies to the function of the cover, which is not adversely affected by having the protecting strands extending thereon.

In a preferred specific embodiment of this concept, the guardbar and the cover are interconnected by side walls, while leaving a central opening in the region of the cutting edge or edges of the razor blade means; the thus-formed upper part of the plastic body is placed upon the base member of the plastic body with its razor blade means including the protective strands that is secured to a support means of the base member, whereupon the upper part is securely connected to the base member. Thus, as a consequence of this one-piece upper part, which is formed from the forward guardbar, the rear cover, and the side strips, a simple assembly of the razor head, and in particular of the razor blade unit, is provided. After the single or in particular double razor blade is secured to the support means of the base member, it is merely necessary to insert the upper part essentially from above onto the base member and to securely connect it thereto. This can be effected, for example, in an interlocking manner or in any other suitable fashion.

The objective of the invention is to provide a razor head that produces a comfortable and safe shave as well as a close and effective shave. The strands are critical to achieving this objective. It is also critical that the spacing between the strands and the thickness of the strands are neither too large nor too small. If the spacing is too large or the thickness too small then the desired safety and comfort will not be achieved. If the spacing is too small and the thickness too large then the desired closeness of the shave will not be achieved.

BRIEF DESCRIPTION OF THE DRAWINGS

This objective, and other objectives and advantages of the present invention, will appear more clearly from the following specification in conjunction with the accompanying schematic drawings, in which.

DESCRIPTION OF PREFERRED EMBODIMENTS

Figure 1:
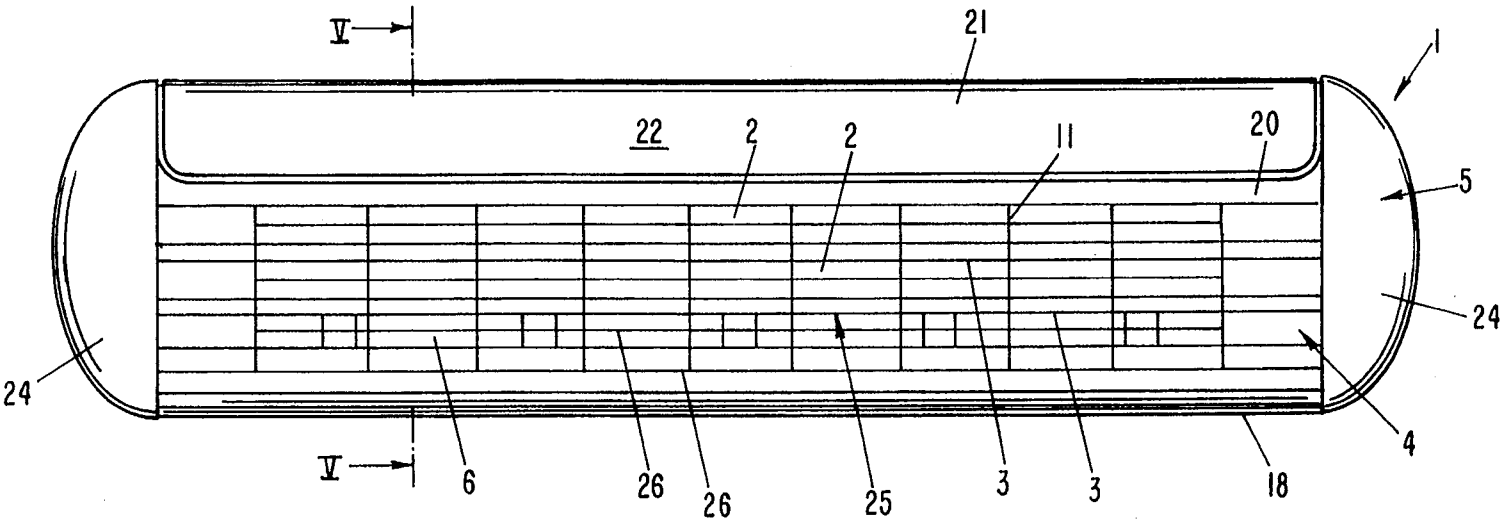
FIG. 1 is a top view of a first exemplary embodiment of the inventive razor head in the form of a razor blade unit of a wet razor.
Figure 2:
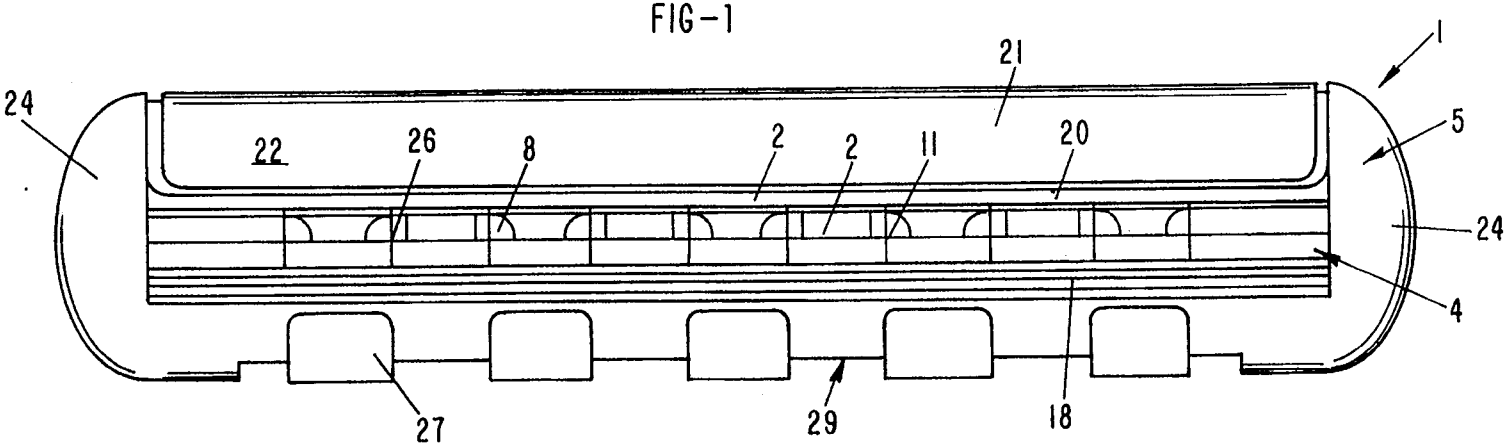
FIG. 2 is a front view of the razor blade unit of FIG. 1.
Figure 3:
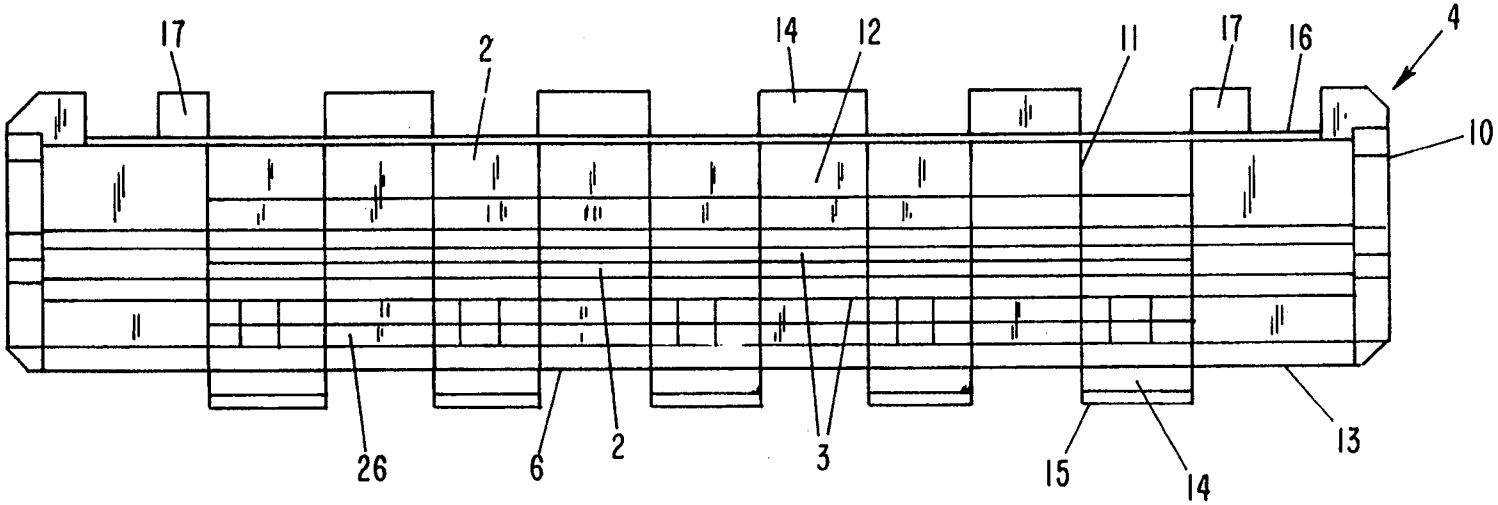
FIG. 3 is a top view of the base member.
Figure 4:
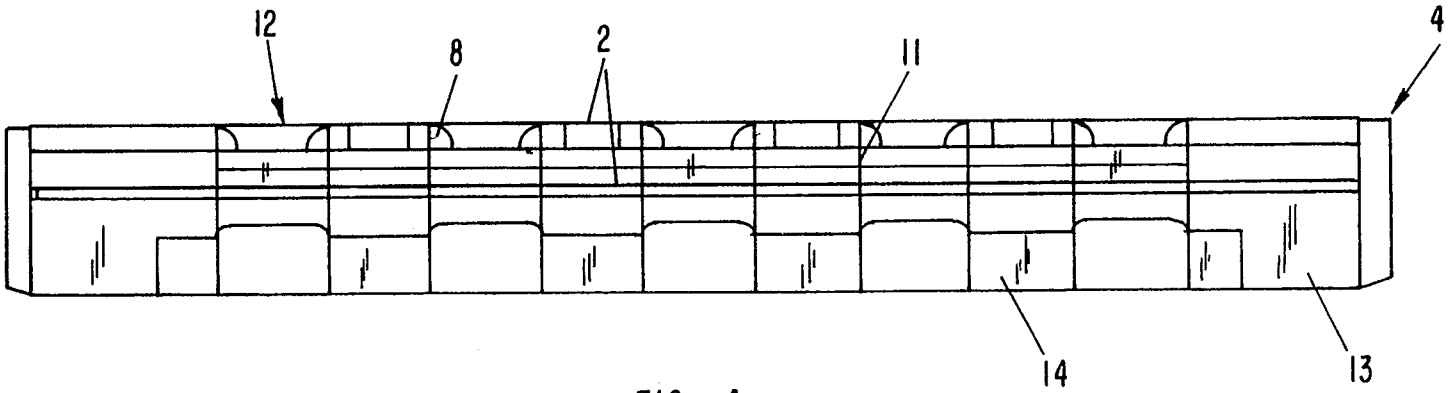
FIG. 4 is a front view of the base member.
Figure 5:
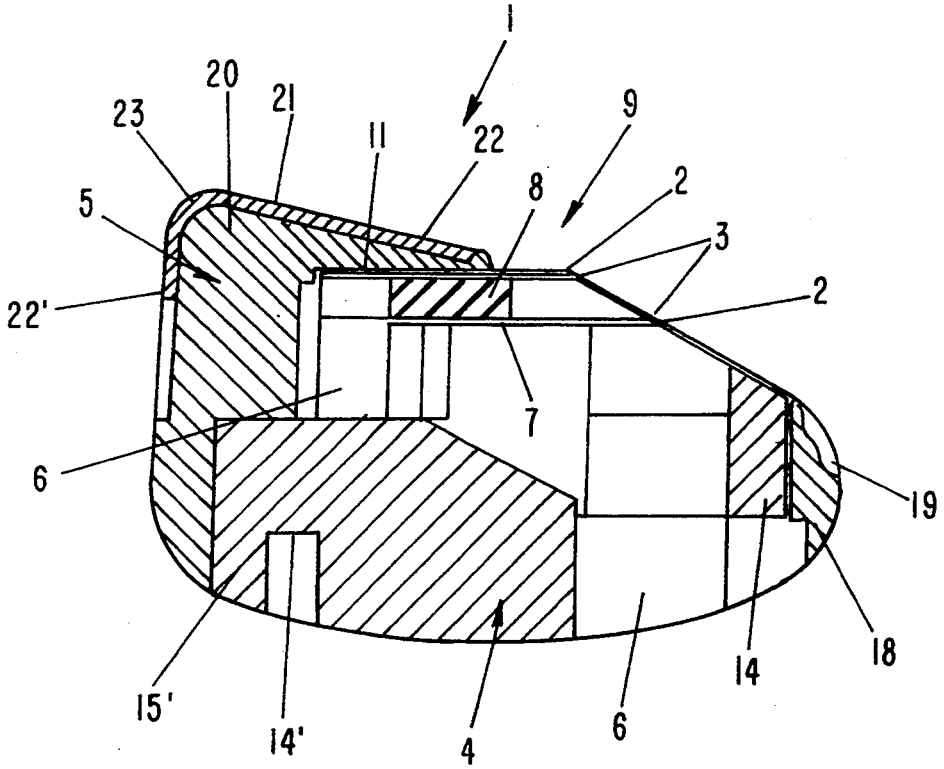
FIG. 5 is an enlarged cross-sectional view taken along the line V—V in FIG. 1.

Referring now to the drawings in detail, the illustrated razor head, which is in the form of a so-called razor blade unit for a wet or safety razor, and which can be secured to the front end of a non-illustrated handle, comprises a plastic body 1 in which are disposed two razor blades 2, the cutting edges 3 of which extend parallel to one another and are offset one behind the other.

The plastic body 1 comprises a base member 4 that is provided with the razor blades 2, as well as an upper part 5 that is placed upon the base member 4.

The base member 4 of the plastic body 1 is provided with through slots 6 that are primarily disposed in the interior thereof. On the upper side, the base member 4 defines a platform or support means 7 for the razor blades 2. For this purpose, a spacer 8 is sandwiched between the two razor blades 2, which are securely connected to the spacer 8. These components thus form a razor blade/spacer/razor blade unit 9, which is placed from above upon the support means 7 of the base member 4. For this purpose, the spacer 8 is provided with projections 17 that extend from the rear and from each end of the spacer 8, which are received in recesses or slots 10 in the sides of the base member 4.

The unit 9 can be covered by a mesh or net 26 comprising strands 11 that extend over the blades. To secure the mesh 26, the lower portion of the front side 13 of the base member 4 is provided with downwardly directed, integral projections 14 that are embodied as elongated strips. The spacing of these projections 14 as viewed in the direction of the cutting edges 3 of the razor blades 2 essentially corresponds to the spacing of the strands 11 of the mesh 26. Alternatively, the mesh 26 can be wrapped completely around the unit 9 and can be secured to itself at its ends. In a further alternative, the mesh 26 can be secured to the unit 9 by means of the projections 17 on the spacer 8; these projections can be located along the rear edge and at each end of the spacer 8.

The upper part 5 is a one-piece plastic component and is provided with a forward guardbar 18 that extends parallel to the cutting edges 3 of the razor blade 2 and is provided with a stepped longitudinal profiling 19. A protective cover 20 is provided in the back region. This cover is provided at the top with a convexly curved glide or antifriction strip 21 having a first leg 22 and a second leg 22' that is disposed at an acute angle to the first leg 22 and is interconnected therewith via a rounded portion 23. The angle between the two legs 22, 22' of the glide strip 21 can also be 90°, or even an obtuse angle. The two legs 22, 22' of the glide strip 21 have an essentially planar or slightly convexly curved configuration. It is possible to produce such a glide strip 21 via a special hot mold process. The particular advantage of this glide strip 21 is that it is also more effective at the end of the razor blade unit. When shaving, the skin is made taut and is pressed in and a bulge is formed at the end of the razor blade unit. Thus, the curved glide strip 21 glides better in this region and thus produces a more comfortable shave.

The forward guide strip or guardbar 18 and the rear cover 20 are interconnected by side walls 24. Disposed between these components is an opening 25 in the vicinity of the cutting edges 3 of the razor blades 2, as can be seen in particular in the top view of FIG. 1.

Figure 6:
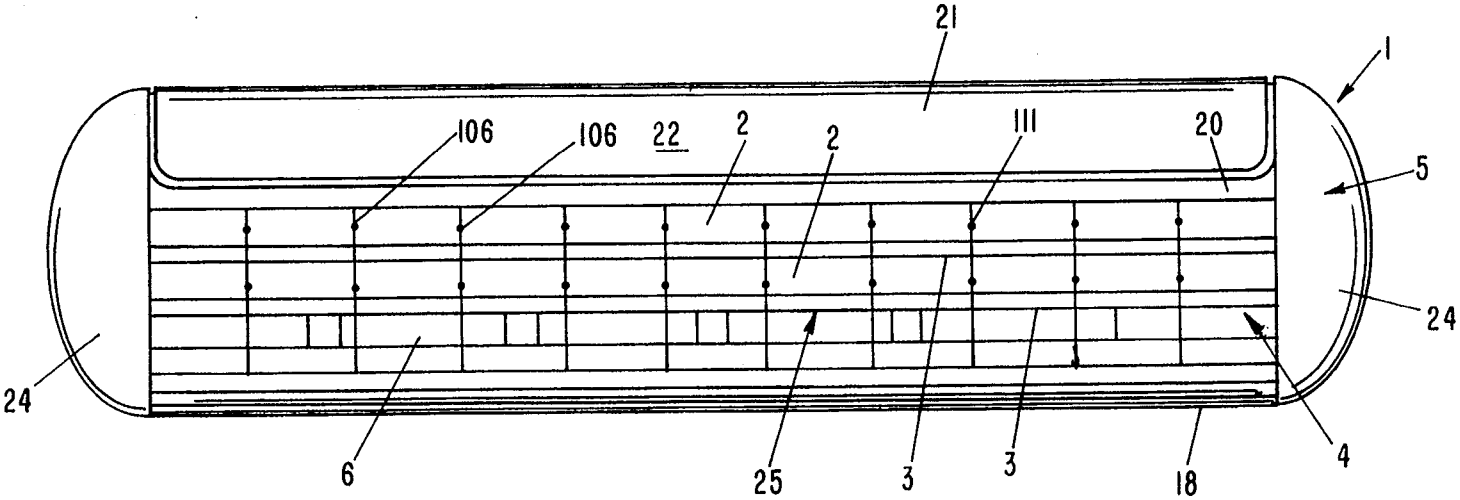
FIG. 6 is a top view of a second exemplary embodiment of the invention with welded strands.

According to one specific embodiment of the invention shown in FIG. 6, wire-type strands 111 are secured to the blades 2 by means of spot welds 106. The wire strands 111 can be wrapped around the blade unit using posts to position the spacing before welding, or alternatively the required number of individual wires could be placed on the top of the unit 9 and could be welded and cut directly during assembly of the blade unit without the need for positioning projections.

Figure 7:
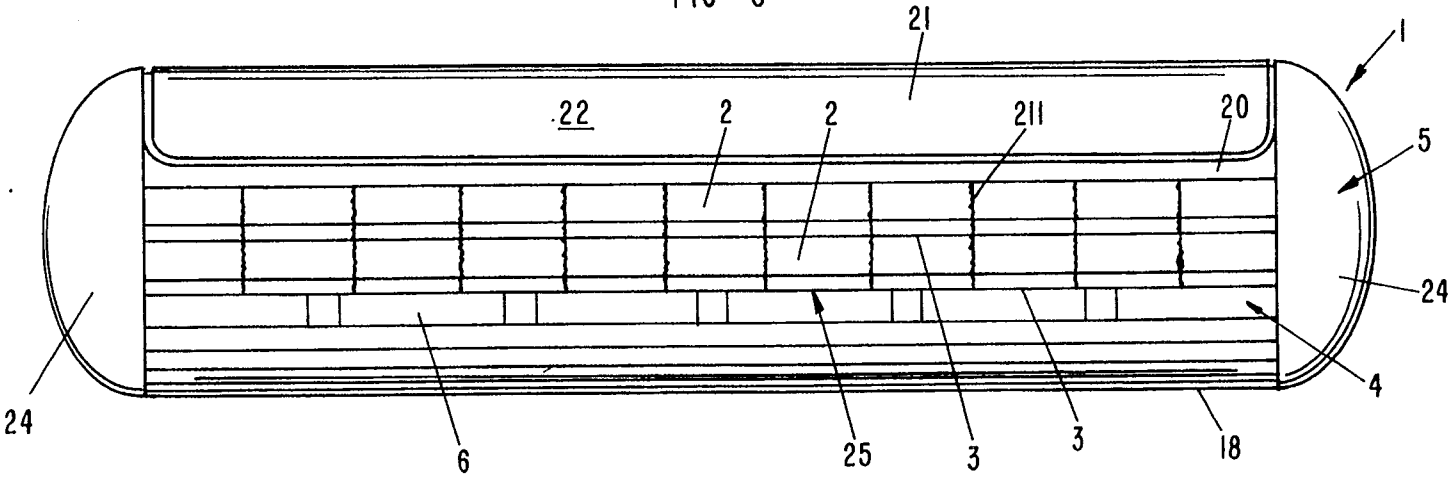
FIG. 7 is a top view of a third exemplary embodiment of the invention with welded beads.

According to another specific embodiment of the invention as shown in FIG. 7, strands are formed by means of bead lines 211 directly on the upper surface of the blade or blades. These bead lines 211 can be formed by depositing molten metal via an arc welding process or by depositing a suitable glue or plastic, the main objective being to produce a narrow bead line that adheres to the blade surface and does not wear off during the shave. Using this method the intricate process of assembling wire or a mesh to the blade unit is avoided completely, thus reducing the cost of manufacture.

In all of the embodiments the strands will be spaced a preferred distance apart and will be of a preferred thickness in order that the objectives of comfort, safety and closeness of shave are achieved. The preferred spacing is at least 2 mm and the preferred thickness is at least 0.1 mm. In certain applications such as for a heavy beard the preferred spacing and thickness are 3 mm and 0.15 mm respectively.

The present invention is, of course, in no way restricted to the specific disclosure of the specification and drawings, but also encompasses any modifications within the scope of the appended claims.

What I claim is:

1. A method of producing a razor head, including the steps of:

providing a plastic body having an upper surface means for engaging the skin of a user, and also having a support means;

disposing razor blade means on said support means; and disposing bead lines formed from molten material directly onto said razor blade means to form strand means fixedly attached along a length of said razor blade means, said strand means comprising a series of spaced-apart strands that are spaced at least 2 mm from one another and have a thickness of at least 0.1 mm.

2. A method according to claim 1, wherein said strands are spaced at least 3 mm from one another and have a thickness of at least 0.15 mm.

3. A method according to claim 1, wherein said bead lines are formed of metal.

4. A method according to claim 3, wherein said bead lines are effected via an arc welding process.

5. A method according to claim 1, wherein said bead lines are made of a material selected from the group consisting of glue and plastic.

6. A method according to claim 1, wherein said razor blade means comprises two razor blades that are connected to opposite sides of a spacer that is disposed between said blades.

7. A method according to claim 6, wherein said strand means forms a mesh or net on said razor blade means.

8. A method according to claim 7, wherein said spacer of said razor blade means is provided with projections, and said mesh is connected to said projections.

* * * * *